United States Patent [19]

Chen

[11] Patent Number: 4,776,352

[45] Date of Patent: Oct. 11, 1988

[54] DISPOSABLE ASHTRAY AND HOLDER THEREFOR

[76] Inventor: Yong F. Chen, 32-4, Lane 286, Da Ya Rd., Taichung, Taiwan

[21] Appl. No.: 900,754

[22] Filed: Aug. 27, 1986

[51] Int. Cl.[4] ..... A24F 19/02; A24F 19/10

[52] U.S. Cl. ..... 131/231; 131/238; 131/241

[58] Field of Search ..... 131/231, 232, 241, 238

[56] References Cited

U.S. PATENT DOCUMENTS

| | | | |
|---|---|---|---|
| 2,788,911 | 4/1957 | Mellon | 131/231 |
| 3,342,317 | 9/1967 | Barron | 131/231 |
| 3,372,724 | 3/1968 | Rouse | 131/231 |
| 4,580,581 | 4/1986 | Reece et al. | 131/231 |

*Primary Examiner*—V. Millin

[57] ABSTRACT

A disposable ashtray made of flame-resistant and/or fire-retardant treated paper comprising two substantically identical sheets bonded together along matching outer contours to define an inner space when said sheets are oppositely pulled. The upper section of both sheets are perforated and enclose at least one ply of an interposed smoke absorbing layer. The lower section of least one of the sheets has at least one mouth-like opening having an integral flapped tongue as a holding platform for an in-use cigarette. In addition, a holder stand for keeping the ashtray upright and stable at an expanded position.

5 Claims, 1 Drawing Sheet

DISPOSABLE ASHTRAY AND HOLDER THEREFOR

BACKGROUND OF THE INVENTION

This invention relates to a disposable ashtray.

The main object of this invention is to provide an enclosed ashtray made of paper material, particularly for reducing smoke pollution and the resultant ill effects from inhaling the smoke.

Another object is to provide an ashtray capable of diminishing scattering of ashes by air movement.

A further object is to provide an ashtray which is replaceable and thus readily kept clean.

A still further object is to provide an ashtray which is shaped like a lung and imprinted with blood vessels. In use the smoke will blacken the paper lung as a visual warning for the smoker to take care of his real lung.

BRIEF DESCRIPTION OF THE DRAWINGS

Aforementioned and other objects will be better understood from the following description in detail with reference to the accompanying drawings, in which.

DETAILED DESCRIPTION OF A PREFERRED EMBODIMENT

Figure 1:
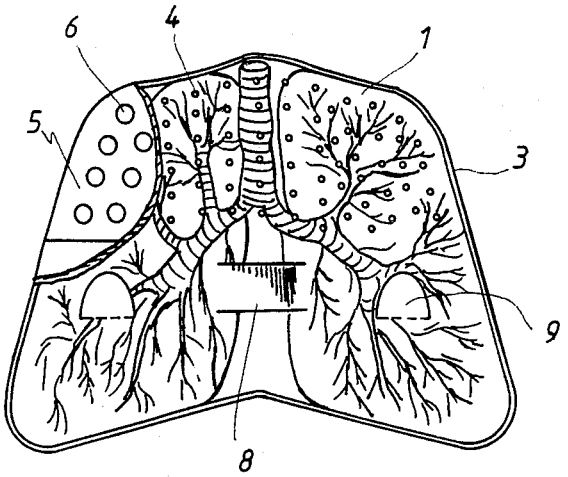
FIG. 1 is a schematic perspective view of the disposable ashtray according to this invention, partly cut away, in a flat position.
Figure 3:
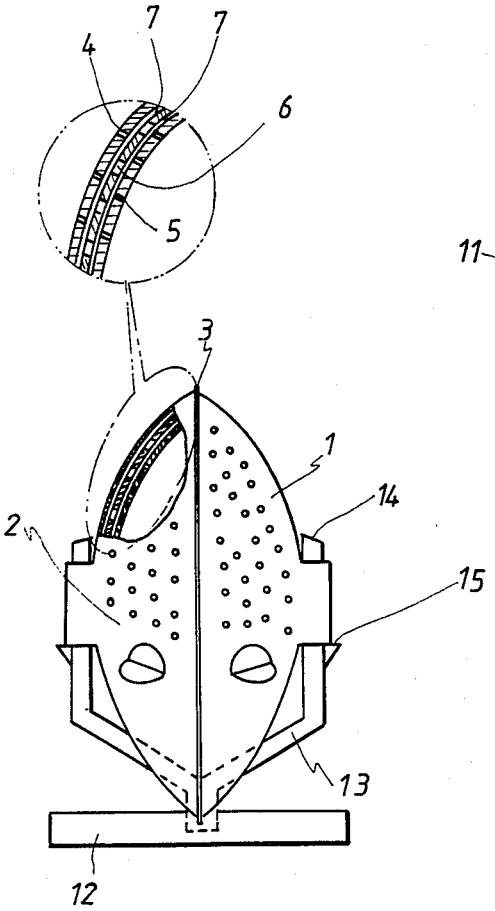
FIG. 3 is a schematic side elevation of FIG. 2, with a partly cut away section.

The disposable ashtray is composed of two sheets, i.e., the front sheet 1, as referred to in FIG. 1, and the rear surface 2, as referred to in FIG. 3. Both sheets 1 and 2 are substantially identical in configuration and bonded to each other by, for example, adhesive along the peripheries 3 thereof to define a space therein. Said space will be greatly enlarged when both sheets 1 and 2 are pulled out radially to prepare for use, as better shown in FIG. 3. Sheets 1 and 2 are made of paper, particularly selected from natural woodpulp, with a thickness and strength sufficient for dimensional stability, and preferably subjected to a finishing treatment by, for example, calendering, pressing, and printing.

Sheets 1 or 2 are divided into an upper side and a lower side of substantially equal distances. The upper side is perforated with a plurality of perforations 4 and attached internally with at least one ply of a smoke absorbing interposed layer 5, of textured fiber material, such as for example, paper tissue, non-woven fabric, and the like. The smoke absorbing layer is perforated with a plurality of holes 6 for air passage. Two smoke absorbing layers 5 are shown in FIG. 3 for illustrative but not limiting purpose. The sheets 1 and 2 and the adjacent layer or layers 5 are bonded at numerous discrete points, such that gaps 7 remain. In addition, the holes 6 of the different layers 5 are not aligned.

The lower side of the sheet 1 or 2, preferably at approximately the center, is formed with two essentially parallel cut lines 8, so that the area between said lines 8 may be raised to form a tab for use in pulling apart sheets 1 and 2. Further, at at least one suitable location sheet 1 or 2 is punched to form a tongue 9 which is still connected to the sheet 1 or 2 at a fold line 10. In FIG. 1 two tongues 9 are punched at symmetrical locations, but their location is not limited to this embodiment. When the tongues 9 are flapped out, the corresponding mouths 10 are exposed and the flapped tongues 9 serve as suspension platforms for the smoker to temporarily place the burning cigarette 11 with the lit end extending through said mouth 10 into the internal space. If both sheets 1 and 2 are punched with mouths 10, then the mouth locations should preferably not be aligned.

The internal space beneath said mouth(s) 10 is used as a trash bag for collection of the ashes and cigarette butts.

Further, the ashtray is preferably formed in the shape of a lung imprinted with a trachea and blood vessels and treated with flame-resisting and/or fire-retarding agent which is available in the market, for use on paperware by, for example, spraying, dipping and other suitable coating treatments.

Figure 2:
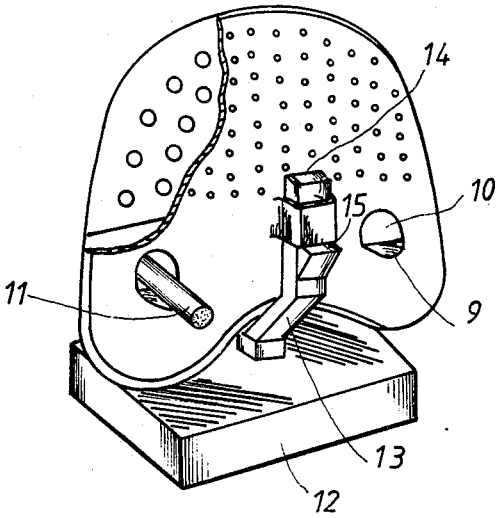
FIG. 2 is a schematic perspective view of the present disposable ashtray, illustrating the in-use position thereof when mounted on a holder, again partly cut away.

The ashtray according to the present invention is preferably used in combination with a holder. As shown in FIGS. 2 and 3, the holder comprises a base 12 and an antler type support planted on said base. The support includes two beams 13, each beam 13 comprises a tine 14 and a branch 15. This holder is only one of the feasible embodiments for illustrative purposes.

In use, one may grip with the thumb and any finger the cut lines 8 on both sheets 1 and 2 to pull said sheets 1 and 2 from the original collapsed position, expanding the inner space outwardly, then inserting each tine 13 through the respective cut lines 8 until the latter are stopped by the corresponding branch 15 to form an expanded internal space. Thus, the ashtray is kept in an expanded in-use position. The cigarette 11 is placed on the flapped tongue 9 with the lit end extended into the internal space. The smoke generated from the lit cigarette fills the internal space and is driven through the smoke absorbing layers 5 by the draft coming through the mouth(s) 10. The smoke should pass through the holes 6 in different layers 5 and through the gaps between the layers 5 as well as between the layers next to sheets 1 and 2 and the sheets 1 and 2 themselves, and then exit through the perforations 4 in the sheets 1 and 2. A portion of the smoke particles deposits along the passages mentioned above and are thus absorbed by the smoke absorbing layers 5 and the sheets 1 and 2. Thereby, the smoke pollution of the air is reduced. The layers 5 and the sheets 1 and 2 upon absorption of the smoke, gradually darken to such an extent that the paper lung on the ashtray is blackened. This will give the smoker a visual warning that his real lung can be effected in the same way and thus make him decrease his smoking frequency to eventually give up smoking.

The aforementioned embodiment serves only for illustrative purposes and by no means restricts the scope of the present invention as defined in the appended claims.

What I claim is:

1. A disposable ashtray comprising: a first sheet of a flame-resistant and/or fire-retardant treated paper; a second sheet of a flame-resistant and/or fire-retardant treater paper of substantially identical configuration as the first sheet; said first and second sheets being attached to each other along essentially matching outer contours, and being adapted to be oppositely pulled apart and in pulled-apart position having sufficient strength for dimensional stability; said first and second sheets each having an upper portion and a lower portion; a plurality of perforations in said upper portions, at least one layer of a smoke absorbing material interposed between said upper portions; at least one of said lower portions being cut to form at least one tongue, said tongue being hinged to said one lower portion to form a support for a cigarette.

2. An ashtray according to claim 1, wherein said lower portions are provided with cut lines defining a tab for pulling said two sheets apart.

3. An ashtray according to claim 1, wherein said smoke absorbing layer is made of textured fiber material with a plurality of perforations.

4. An ashtray according to claim 1, wherein said sheets are essentially lung-shaped and provided with an image of blood vessels and a trachea thereon.

5. An ashtray according to claim 2, in combination with a base, and an antler-shaped support connected to said base and supporting said tabs when said sheets are in pulled-apart position.

* * * * *